US007824154B2

(12) United States Patent
Yabuuchi

(10) Patent No.: US 7,824,154 B2
(45) Date of Patent: Nov. 2, 2010

(54) MOTOR HAVING HEAT-DISSIPATING STRUCTURE FOR CIRCUIT COMPONENT AND FAN UNIT INCLUDING THE MOTOR

(75) Inventor: Yuji Yabuuchi, Kyoto (JP)

(73) Assignee: Nidec Corporation, Kyoto (JP)

( * ) Notice: Subject to any disclaimer, the term of this patent is extended or adjusted under 35 U.S.C. 154(b) by 752 days.

(21) Appl. No.: 11/758,135

(22) Filed: Jun. 5, 2007

(65) Prior Publication Data

US 2007/0286726 A1 Dec. 13, 2007

(30) Foreign Application Priority Data

Jun. 9, 2006 (JP) ..... 2006-160378
May 24, 2007 (JP) ..... 2007-137313

(51) Int. Cl.
*F04D 29/52* (2006.01)

(52) U.S. Cl. ..... 415/211.2; 415/220; 416/223 R; 416/235

(58) Field of Classification Search ..... 415/191, 415/208.2, 211.2, 185, 193, 220, 178; 416/223 R, 416/235
See application file for complete search history.

(56) References Cited

U.S. PATENT DOCUMENTS 4,895,489 A * 1/1990 Kohama et al. ..... 415/218.1
6,045,327 A * 4/2000 Amr ..... 415/211.2
6,544,010 B1 * 4/2003 Choi ..... 417/423.1
6,547,540 B1 * 4/2003 Horng et al. ..... 417/423.14
6,981,843 B2 1/2006 Chiu et al.
7,052,236 B2 * 5/2006 Chang et al. ..... 415/191
7,275,910 B2 * 10/2007 Chang et al. ..... 415/211.2
7,275,911 B2 * 10/2007 Lee et al. ..... 415/211.2
2006/0042894 A1 * 3/2006 Lee et al. ..... 188/267

FOREIGN PATENT DOCUMENTS

CN 1699760 A 11/2005
JP 63-032198 2/1988
JP 2702755 10/1997
JP 2002-021798 1/2002

OTHER PUBLICATIONS

Office Action Dated Dec. 26, 2008 Issued by SIPO in Related China Application No. 200710108970.3.

* cited by examiner

*Primary Examiner*—Igor Kershteyn
(74) *Attorney, Agent, or Firm*—Keating & Bennett, LLP

(57) ABSTRACT

An impeller includes an impeller cup and a plurality of blades. The impeller cup is hollow and generally cylindrical and has a lid. A housing is formed to enclose the impeller from the outside thereof. The housing has a wall defining a passage of an airflow generated by rotation of the impeller. At axial ends of the passage are formed an air inlet and an air outlet, respectively. The wall is provided with an air-inlet side portion which has an inner diameter increasing toward the air inlet. An axially upper end of a radially outer edge of each blade axially projects toward the air inlet beyond the lid of the impeller cup, and is located to be covered by the air-inlet side portion when seen from the outside in the radial direction. An axially upper end of a radially inner edge of each blade is located on a base portion side of the lid of the impeller cup. An axially upper edge of each blade is at an angle with respect to the axial direction so as to get close to the base portion in a direction from the radially outer edge of each blade to a radially inner edge.

12 Claims, 8 Drawing Sheets

MOTOR HAVING HEAT-DISSIPATING STRUCTURE FOR CIRCUIT COMPONENT AND FAN UNIT INCLUDING THE MOTOR

BACKGROUND OF THE INVENTION

1. Field of the Invention

The present invention relates to an axial fan. More particularly, the present invention relates to a blade shape in the axial fan.

2. Description of the Related Art

Most electronic devices generate heat therein and use cooling fans for dissipating the heat. In recent years, the amount of heat has continued to increase with improvement of performance of the electronic devices. The increase in the amount of heat raises a required level of performance of the cooling fans, which in turn requires improvement of flow rate characteristics and static pressure characteristics. Both those characteristics can be improved by rotating the cooling fans at higher speeds. However, because of increasing use of electronic devices in office and at home, demands of reduction in noises during rotation of the cooling fans are increasing.

The size of casings of electronic devices has continued to be reduced in recent years. The reduction in casing size has imposed various limitations on a space for installing a cooling fan. For example, in order to achieve sufficient cooling performance of the cooling fan, an unoccupied space has to be provided in the electronic device next to an air-inlet side of the cooling fan so as for another component or device to disturbing the cooling fan from drawing in air. However, because of the reduction in casing size described above, it is not possible to form the unoccupied space required for drawing-in of sufficient air next to the air-inlet side of the cooling fan.

SUMMARY OF THE INVENTION

According to a preferred embodiment of the present invention, an axial fan includes the following structure. A cup is centered on a rotation axis and has at least a hollow, generally cylindrical portion. A plurality of blades extend from an outer side surface of the cup in a radial direction perpendicular to or substantially perpendicular to the rotation axis. The blades are arranged to turn about the rotation axis together with the cup to generate an axial airflow. A hosing defines a passage for the airflow therein with an air inlet at one of axial ends of the passage and an air outlet at the other axial end. Air is drawn into the passage from the air inlet and being discharged from the air outlet. The housing includes an air-inlet side portion having such an inner diameter that a cross-sectional area of the passage on a plane perpendicular to the axial direction increases toward the air inlet. A motor is accommodated in the cup and is arranged to rotate the cup. A base portion supports the motor. A plurality of ribs extend from the base portion to the housing and connect the base portion to the housing. Each blade is connected to the cup at a root portion thereof. An air-inlet side end of the root portion is located on an air-outlet side of an air-inlet side end of the cup portion. An air-inlet side end of a radially outer edge of each blade is located on an air-inlet side of the air-inlet side end of the cup and axially between an air-inlet side end of the housing and a portion of the housing at which a cross-sectional area of the passage on a plane perpendicular to the rotation axis is the smallest.

Other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
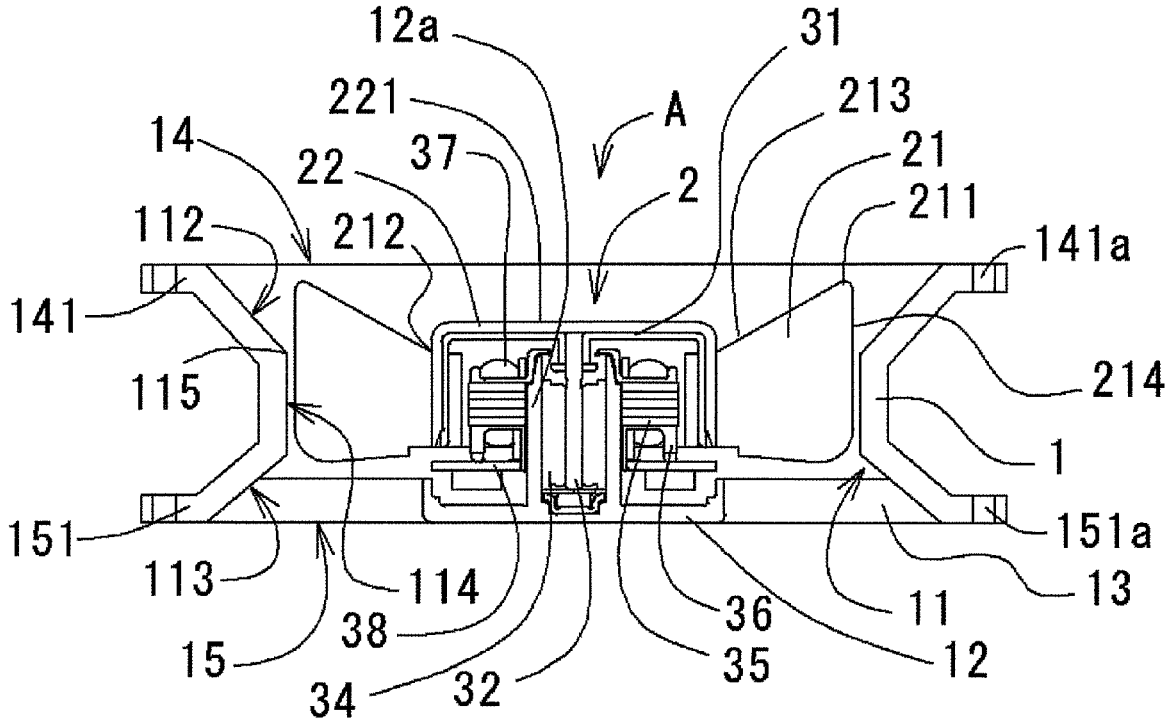
FIG. 1 is a cross-sectional view of an axial fan according to a preferred embodiment of the present invention.

Referring to FIGS. 1 through 8D, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

Figure 2:
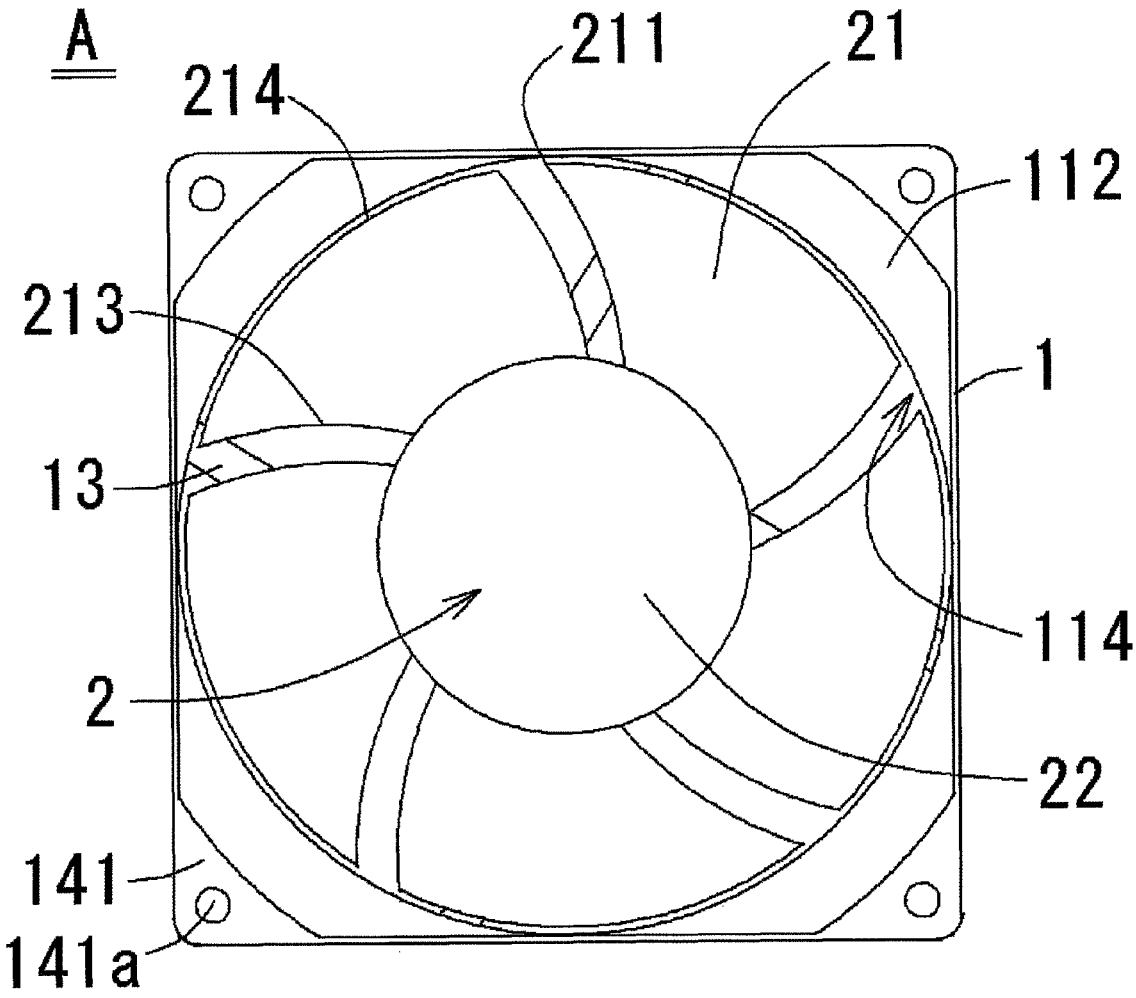
FIG. 2 is a plan view of the axial fan of FIG. 1.

FIG. 1 is a cross-sectional view of an axial fan according to a preferred embodiment of the present invention. FIG. 2 is a plan view of the axial fan of FIG. 1. The axial fan A of the preferred embodiment is now described referring to FIGS. 1 and 2.

The axial fan A includes a rotor yoke 31 and an impeller 2 which is attached to the rotor yoke 31 and has a plurality of blades 21. The rotor yoke 31 is a hollow, generally cylindrical member and has a lid at its one axial end. When electric current is supplied to the axial fan A from the outside, the rotor yoke 31 rotates about its center axis as a rotation axis and the impeller 21 also rotates together with the rotor yoke 31. A shaft 32 is secured at its one axial end to the rotor yoke 31 in order to rotate the rotor yoke 31. The shaft 32 is coaxial with the rotation axis of the rotor yoke 31.

In the axial fan A, a base portion 12 is provided to face an opening end of the rotor yoke 31. The base portion 12 includes a hollow, generally cylindrical bearing housing 12*a* which is arranged coaxially with the rotation axis of the rotor yoke 31. The bearing housing 12*a* has a bottom at its one axial end.

A sleeve 34 is inserted into the bearing housing 12*a* by press fitting, for example. Thus, the sleeve 34 is secured to the inner circumferential surface of the bearing housing 12*a*. The sleeve 34 has an insertion hole into which the shaft 32 is to be inserted. When the shaft 32 is inserted into the insertion hole, the sleeve 34 supports the shaft 32 in a rotatable manner. In this preferred embodiment, the sleeve 34 forms a portion of an oil-impregnated bearing which is made of porous material, e.g., sintered metal impregnated with lubricating oil. Thus, the lubricating oil exists between the inner circumferential surface of the sleeve 34 and the outer surface of the shaft 32 which are opposed to each other. The shaft 32 is supported by the sleeve 34 in a rotatable manner via the lubricating oil.

Although the oil-impregnated bearing as an exemplary sliding bearing is used in this preferred embodiment, the bearing that can be used in the present invention is not limited thereto. For example, a rolling-element bearing such as a ball bearing may be used. The bearing used in the axial fan of the present invention is appropriately selected in accordance with required characteristics of the axial fan and the cost.

The axial fan A also includes a stationary portion 3 supported by the outer circumferential surface of the bearing housing 12*a*. The stationary portion 3 includes a stator core 35, coils 37, an insulator 36 and a circuit board 38. The stator core 35 having a plurality of teeth is enclosed with the insulator 36 in such a manner that each axial end of the stator core 35 is electrically insulated. Similarly, the insulator 36 also electrically insulates each tooth of the stator core 35. A conductive wire is wound around the each tooth via the insulator 36 to form the coil 37. With this configuration, the stator core 35 and the coils 37 are insulated from each other.

As shown in FIG. 1, the circuit board 38 is disposed axially below a stator assembly including the stator core 35, the insulator 36, and the coils 37. The circuit board 38 includes a printed circuit board and an electronic component mounted thereon (not shown). A circuit wiring on the printed circuit board and the electronic component form together a driving control circuit for controlling rotation of the impeller 2. The electronic component of the circuit board 38 is electrically connected to an end of the conductive wire extending from the coils 37. The circuit board 38 is secured to an axially lower end of the insulator 36. Electric current supplied to the axial fan A from the outside flows through the electronic component (e.g., an IC and/or a Hall element) of the circuit board 38 and then through the coils 37. With this configuration, it is possible to control a magnetic field generated around the stator core 35.

The impeller 2 has an impeller cup 22 and a plurality of blades 21 disposed radially about the rotation axis with regular circumferential intervals. The impeller cup 22 is a hollow, generally cylindrical member and has a lid 221 at its one axial end. The blades 21 are turned about the rotation axis together with rotation of the impeller cup 22, thereby generating airflow. In this preferred embodiment, the blades 21 are provided on and connected to the outer circumferential surface of the impeller cup 22.

The rotor yoke 31 for reducing magnetic flux leakage to the outside of the axial fan A is provided radially inside the impeller cup 22. On the inner circumferential surface of the rotor yoke 31 is attached a rotor magnet 33. The rotor yoke 31 is made of magnetic material and can prevent leakage of magnetic fluxes generated by the rotor magnet 33 to the outside of the impeller cup 22. The rotor magnet 33 is magnetized in such a manner that different magnetic poles are alternately arranged in the circumferential direction. When the shaft 32 secured to the rotor yoke 31 coaxially with the rotation axis is inserted into the sleeve 34, the radially inner surface of the rotor magnet 33 faces the radially outer surface of the stator core 35 in the radial direction.

When electric current flows through the coils 37 in this axial fan A, a magnetic field generated by the stator core 35 interacts with a magnetic field generated by the rotor magnet 33 so as to generate a rotational torque which rotates the impeller 2 about the rotation axis. While the impeller 2 is rotating together with the rotor yoke 31 and the rotor magnet 33, a change of magnetic fluxes of the rotor magnet 33 is detected by a Hall element and an output voltage of the driving control circuit for driving the rotation of the impeller 2 is controlled based on the detection result. In this manner, the rotation of the impeller 2 can be controlled to be stable. When the impeller 2 is rotated, the blades 21 pushes air axially downward (downward in FIG. 1), thereby generating an axial airflow.

In this preferred embodiment, the lid of the rotor yoke 31 (the upper surface of the rotor yoke 31 in FIG. 1) is covered by the lid 221 of the impeller cup 22, as shown in FIG. 1. However, the structure of the impeller cup 22 is not limited thereto. For example, the lid 221 of the impeller cup 22 has an opening that allows the lid of the rotor yoke 31 to be exposed. It is only necessary that at least one of a portion of the impeller cup 22 and a portion of the rotor yoke 42 closes an axially upper end of the impeller cup 22 and rotor yoke 31.

The base portion 12 faces the circuit board 38 in the axial direction. The base portion 12 is a generally circular plate having approximately the same diameter as the outer diameter of the circuit board 38. The base portion 12 is connected to a housing 1 with four ribs 13 which are radially disposed about the rotation axis with regular circumferential intervals. Please note that the number of the ribs 13 is not limited to four. For example, three or five ribs 13 may be provided.

The housing 1 is formed radially outside the impeller 2, thereby enclosing the impeller 2 in the radial direction. The housing 1 includes a wall 11 which defines a passage of an airflow generated by rotation of the blades 21 of the impeller 2. Axially upper and lower ends of the housing 1 are generally square when seen in the axial direction. Flanges 141 are formed at four corners of the axially upper end of the housing 1. Flanges 151 are formed at four corners of the axially lower end of the housing 1. The flanges 141 and 151 project outward in the radial direction. Each of the flanges 141 and 151 has an attachment hole 141*a* or 151*a*. In each of the attachment holes 141*a* and 151*a*, an attachment tool such as a screw is inserted when the axial fan A is installed in an electronic device.

An air inlet 14 is formed at one of axial ends of the axial fan A, and an air outlet 15 is formed at the other axial end. That is, the air inlet 14 and the air outlet 15 are located at the axial ends of an airflow passage. In the example of FIG. 1, the air inlet 14 is formed at an axially upper end and the air outlet 15 is formed at an axially lower end.

A portion of the wall 11, which is adjacent to the air inlet 14, is inclined with respect to the axial direction in such a manner that a cross-sectional area of the airflow passage defined in the housing 1 on a plane perpendicular to or substantially perpendicular to the axial direction increases toward the air inlet 14. Hereinafter, this portion of the wall 11 is referred to as an air-inlet side portion 112. Similarly, a portion of the wall 11, which is adjacent to the air outlet 15, is inclined with respect to the axial direction in such a manner that the cross-sectional area of the airflow passage on a plane perpendicular to or substantially perpendicular to the axial direction increases toward the air outlet 15. Hereinafter, this portion of the wall 11 is referred to as an air-outlet side portion 113. In other words, the inner diameter of the air-inlet side portion 112 of the wall 11 is increased upwardly in the axial direction, while the inner diameter of the air-outlet side portion 113 is increased downwardly in the axial direction. In this preferred embodiment, each of the air-inlet side portion 112 and the air-outlet side portion 113 is formed by a generally conical surface, as shown in FIG. 1.

In this preferred embodiment, the housing 1 has a generally rectangular outer shape when seen in the axial direction, as shown in FIG. 2. Thus, the increasing direction of the cross-sectional area of the airflow passage defined by the air-inlet side portion 112 or the air-outlet side portion 113 on a plane perpendicular to or substantially perpendicular to the axial direction is toward the four corners of the housing 1. That is, the increasing direction of the inner diameter of each of the air-inlet side portion 112 and the air-outlet side portion 113 is toward the four corners of the housing 1 in the radial direction.

Figure 3:
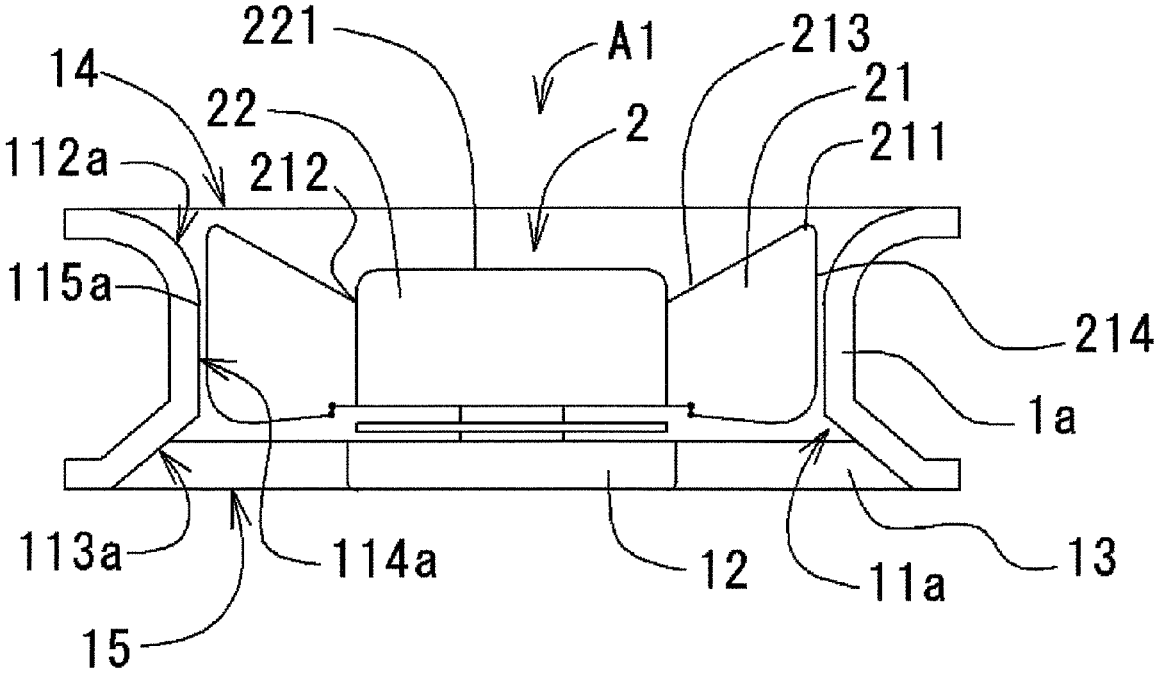
FIG. 3 shows an exemplary modification of the axial fan of FIG. 1.
Figure 4:
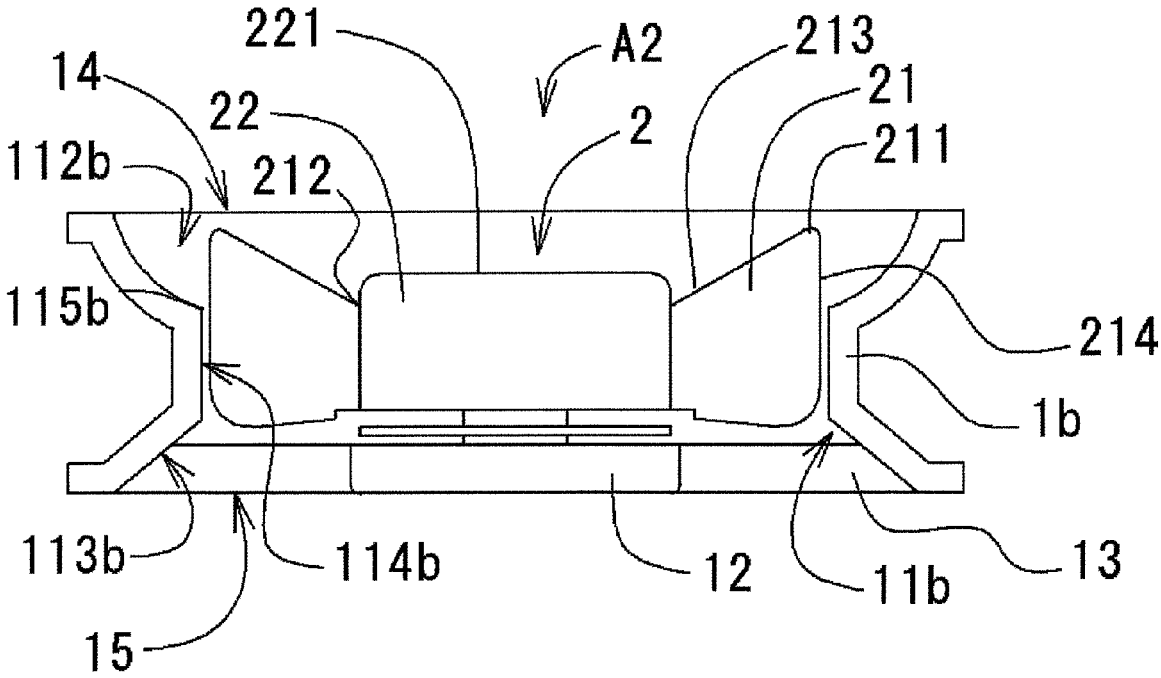
FIG. 4 shows another exemplary modification of the axial fan of FIG. 1.

The shape of the air-inlet side portion 112 and that of the air-outlet side portion 113, which are adjacent to the air inlet 14 and the air outlet 15, respectively, are not limited to the shapes shown in FIG. 1. FIGS. 3 and 4 show exemplary modifications of the axial fan A of FIG. 1. In the axial fan A1 of FIG. 3, a portion 112*a* of the wall 11 which is adjacent to the air inlet 14 is curved and is convex radially inwardly. In the axial fan A2 of FIG. 4, a portion 112*b* of the wall 11 which is adjacent to the air inlet 14 is curved and is convex radially outwardly. When the air-inlet side portion of the wall 11 is curved so as to be convex radially inwardly, as shown in FIG. 3, the pressure of air drawn in changes slowly. Thus, noises can be reduced. When the air-inlet side portion of the wall 11 is curved so as to be convex radially outwardly, as shown in FIG. 4, a larger space from which air is drawn in can be formed between the impeller 2 and the air inlet 14. Thus, the axial fan A can provide a high flow rate.

The shape of the portion of the wall 11 adjacent to the air inlet 14 can have any shape, as long as the cross-sectional area of the airflow passage on a plane perpendicular to or substantially perpendicular to the axial direction increases toward the air inlet 14. Similarly, the shape of the portion of the wall 11 adjacent to the air outlet 15 can have any shape, as long as the cross-sectional area of the airflow passage on a plane perpendicular to or substantially perpendicular to the axial direction increases toward the air outlet 15. The shapes of the portions of the wall 11 adjacent to the air inlet 14 and the air outlet 15 are appropriately designed in accordance with the required characteristics of the axial fan.

Returning to FIG. 1, in the axial fan A of this preferred embodiment, a portion of the wall 11 between the air-inlet side portion 112 and the air-outlet side portion 113 (hereinafter, referred to as a straight portion 114) has a substantially constant inner diameter. However, the inner diameter of the straight portion 114 is not completely constant in this preferred embodiment. Since the housing 1 is made of resin by injection molding in this preferred embodiment, the straight portion 114 is slightly inclined with respect to the axial direction by a small draft angle for easy removal of the mold.

Alternatively, the straight portion 114 may be formed by a generally conical surface in such a manner that its inner diameter gradually increases toward the air inlet 14. In this case, the flow rate characteristics can be adjusted. The same can be applied to straight portions 114*a* and 114*b* of the axial fans A1 and A2 shown in FIGS. 3 and 4.

As shown in FIG. 2, when being projected onto a plane perpendicular to or substantially perpendicular to the axial direction, each blade 21 extends at an angle to a line radially extending from a root portion of that blade 21. Moreover, the cross-sectional shape of each blade 21 on a plane perpendicular to or substantially perpendicular to the radial direction is inclined with respect to the axial direction and curved in such a manner that an axially upper edge of the blade 21 is located ahead of an axially lower edge thereof in the rotating direction of the impeller 2.

Flow rate characteristics and static pressure characteristics of an axial fan used for cooling the inside of an electronic device are usually determined in accordance with system impedance inside the electronic device, i.e., a relationship between the static pressure and the flow rate in the electronic device. In many electronic devices, electronic components, a power supply, and the like are concentrated in a small space and therefore the system impedance is high. That is, it is hard for air to flow. Thus, it is necessary for axial fans for cooling the inside of electronic devices to have a high static pressure.

One approach to achieve a high static pressure is to reduce the interval between the blades 21 adjacent to each other in the circumferential direction (rotating direction of the impeller 2) when the blades 21 are projected onto a plane perpendicular to or substantially perpendicular to the axial direction. This can be achieved by increasing the arc length of the blade 21 in a cross section on a plane perpendicular to or substantially perpendicular to the radial direction, radially outwardly. In this case, however, the axial length of the blade 21 increases radially outwardly. As a difference of the axial length of the blade 21 between in a radially inner portion thereof and in a radially outer portion thereof is smaller, the effective volume occupied by the blades 21 in the housing 1 becomes larger. Please note that the effective volume occupied by the blades 21 is a product of the axial height of the blade 21 and the area of each blade 21 projected on a plane perpendicular to or substantially perpendicular to the axial direction, i.e., the volume of the space through which the blades 21 pass when the blades 21 are turned about the rotation axis. The axial fan A of a high flow rate and a high static pressure can be designed by making the effective volume occupied by the blades 21 larger. In order to achieve this, it is preferable that an angle of the arc-shaped portion of the blade 21 in the cross section on a plane perpendicular to or substantially perpendicular to the radial direction, with respect to the axial direction increase radially outwardly.

In this preferred embodiment, an air-inlet side end 211 of a radially outer edge 214 of each blade 21 is located on the air-inlet 14 side of the lid 221 of the impeller cup 22 in the axial direction (i.e., on the air-inlet 14 side of an air-inlet side end of the impeller cup 22). Moreover, a root portion of the blade 21, which is a radially innermost portion connected to the impeller cup 22, is arranged in such a manner that an air-inlet side end 212 of the root portion is located on the air-outlet 15 side of the lid 221. Moreover, the air-inlet side end 212 is disposed on the air-inlet 14 side of a midpoint of the axial length of the impeller cup 22 (a point at which an axial distance from the lower end of the impeller cup 22 is a half of the axial length of the impeller cup 22), as shown in FIG. 1. Furthermore, the air-inlet side end 211 of the radially outer edge 214 of the blade 21 is arranged between a boundary 115 between the air-inlet side portion 112 and the straight portion 114 of the wall 11 and the air-inlet 14 side end of the wall 11. In other words, the air-inlet side end 211 is covered by the air-inlet side portion 112 of the wall 11 when seen from the outside in the radial direction.

An edge 213 connecting the air-inlet side end 211 of the radially outer edge 214 to the air-inlet side end 212 of the root portion of the blade 21 gets closer to the air outlet 15 as it moves radially inwardly. This edge is referred to as a front edge 213 in the following description. That is, the front edge 213 is at an angle to the axial direction, not perpendicular to the axial direction. Such a shape of the blade 21 can increase the amount of air drawn in by rotation of the impeller 2. While the impeller 2 rotates, surfaces of the blades 21 apply an axially downward force to air. Since a plurality of blades 21 pass through the airflow passage defined in the housing 1 intermittently along the circumferential direction during rotation of the impeller 2, a stable airflow is generated. The flow rate of the airflow depends on the shape of the front edge 213 that first applies a pressure directly to air. The longer the front edge 213 is, the more the amount of air is scraped out axially downward. In other words, when an area of projection of each blade 21 when seen in the rotation direction of the blades 21 is increased, the workload applied to air by rotation of the blade 21 increases. Thus, the flow rate is also increased. Please note that "the area of projection of the blade 21 when seen in the rotation direction" means, on a plane perpendicular to the rotating direction of the impeller 2 and including the axial direction, the area of a region through which all portions of the blade 21 pass. The length of the front edge 213 is longer in a case where the front edge 213 is not perpendicular to the axial direction and gets closer to the air inlet 14 as it moves radially outwardly, than in a case where the front edge 213 perpendicular to the axial direction.

Figure 5:
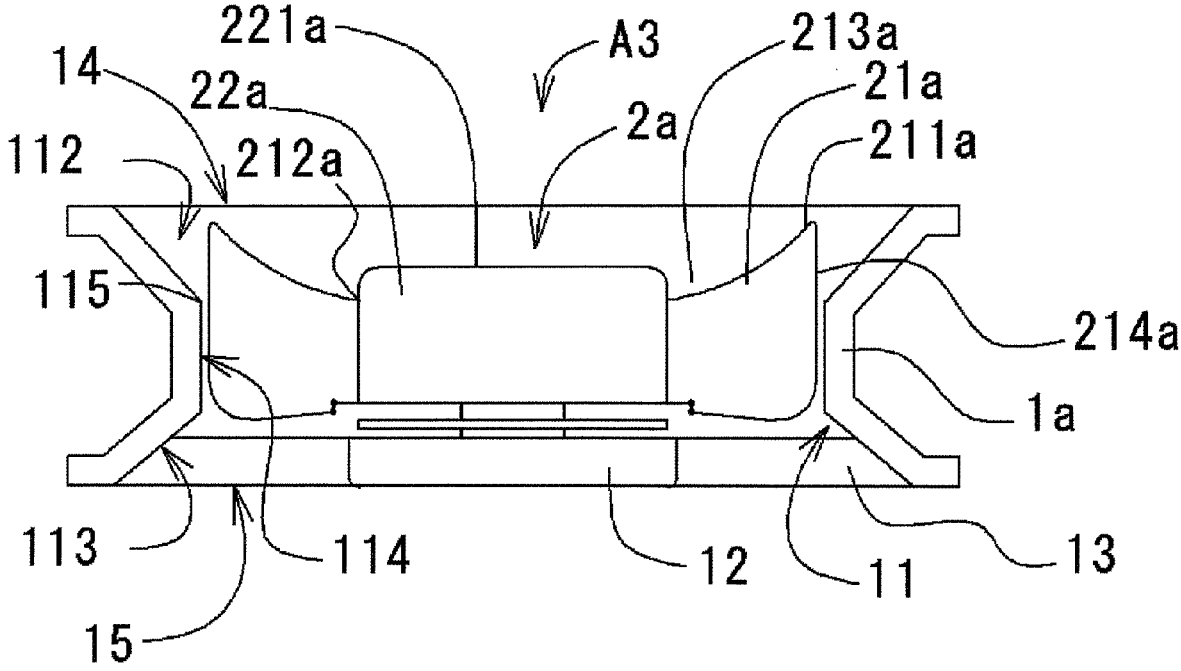
FIG. 5 shows still another exemplary modification of the axial fan of FIG. 1.
Figure 6:
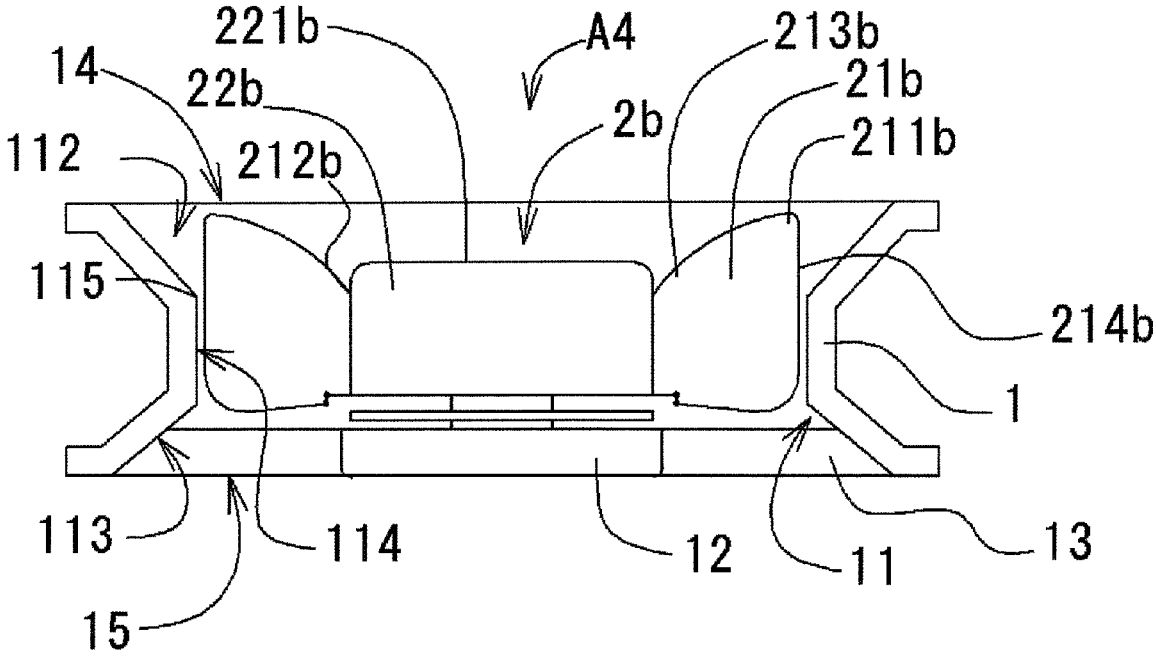
FIG. 6 shows still another exemplary modification of the axial fan of FIG. 1.

The shape of the front edge 213 making the length thereof longer is not limited the aforementioned shape. For example, as shown in FIGS. 5 and 6, the front edge 213 may be curved when seen from in the rotating direction of the impeller 2. In the axial fan A3 of FIG. 5, the front edge 213*a* is slightly convex radially outwardly. That is, an envelope of the front edge 213 when the blade 21 is turned about the rotation axis is curved so as to be concave away from the rotation axis. In this case, a space from which air is drawn in can be made larger. In the axial fan A4 of FIG. 6, the front edge 213*b* is slightly convex radially inwardly. That is, the envelope of the front edge 213*b* when the blade 21*b* is turned about the rotation axis is curved so as to be convex toward the rotation axis. In this case, an area of projection of the blade 21 when seen in the rotating direction of the impeller 2*b* can be made larger. The shape of the front edge of the blade is not limited to those shown in FIGS. 1, 5, and 6, but can be appropriately designed in accordance with the required flow rate characteristics of the axial fan and the environment where the axial fan is used.

How to determine the position of the axially upper end (air-inlet side end) 212 of the root portion of the blade 21 in the axial direction is now described.

In a case where the axially upper end 212 of the root portion is arranged on the air-outlet 15 side of the lid 221 of the impeller cup 22, as shown in FIG. 1, an area of projection of the blade 21 when seen from in the rotating direction is smaller than that in a case where the axially upper end 212 of the root portion of the blade 21 is arranged at the same height from the lower end of the impeller cup 22 as the lid 221 in the axial direction. Please note that the area of projection of the blade 21 when seen in the rotating direction means, on a plane which is perpendicular to or substantially perpendicular to the rotating direction and contains the axial direction, an area of a region through which all portion of the blade 21 pass during a period between passing of a leading end of the blade 21 and passing of a trailing end thereof. Even when the area of projection of the blade 21 is smaller, however, a space from which air can be drawn in is formed between the air-inlet 14 side end of the axial fan A and the front edge 213 of the blade 21 in this preferred embodiment. Thus, the air intake efficiency of the axial fan A is increased. In a case where the axially upper end 212 of the root portion of the blade 21 is too close to the air-outlet side end of the impeller cup 22, e.g., is disposed at a position on the air-outlet 15 side of the axially midpoint of the impeller cup 22 at which the distance from the air-outside end of the impeller cup 22 is a half of the axial length of the impeller cup 22, the area of projection of the blade 21 as seen in the rotating direction is too small. Thus, it is difficult to provide a sufficient flow rate.

In this preferred embodiment, the air-inlet side end 211 of the radially outer edge 214 of the blade 21 is at the same level as a point on the air-inlet side portion 112 of the wall 11 in the axial direction. That is, when seen in the radial direction, the top end 211 of the blade 21 is coincident with a point in the air-inlet side portion 112. Radially between the air-inlet side portion 112 and the top end 211 of the blade 21 is formed a space from which air is drawn in. In other words, a radial gap between the blade 21 and the inner surface of the wall 11 serves as the space from which air is drawn in. When the blades 21 are turned about the rotation axis, an airflow is generated which flows radially inwardly and toward the air outlet 15 from near the radially outer edge 214 of the blade 21 which includes the air-inlet side end 211. In this manner, the axial fan A of this preferred embodiment can draw air in from the entire air-inlet side space (i.e., the space radially outside the blade 21 and the space axially above the front edge 213 of the blade 21) inside the housing 1. Therefore, the flow rate characteristics of the axial fan A can be improved.

In a region where the radially outer edge 214 of the blade 21 is radially opposed to the straight portion 114 of the wall 11 including the boundary 115 between the air-inlet side portion 112 and the straight portion 114, a radial distance between the blade 21 and the straight portion 114 is small. Thus, it is difficult for air to flow toward the air-inlet side. This means that the static pressure characteristics are not degraded.

In this preferred embodiment, air is drawn in from both the space axially above the front edge 213 of the blade 21 and the space radially outside the outer edge 214. The airflow from the radially outer side of the blade 21 and the airflow flowing in the radially inner side of the blade 21 merge in a single flow on a surface of the blade 21 which applies a pressure to air, and affect each other to flow toward the air-outlet side.

In most electronic devices, there is usually no component or device arranged next to the air-inlet side of an axial fan. This is because, if a component or device is arranged next to the air-inlet side of the axial fan, it disturbs the axial fan from drawing air in. However, in order to achieve size reduction of electronic devices, which has been demanded in recent years, a component or device may be disposed next to the air-inlet side of the axial fan. Considering this situation, it is hard for axial fans of conventional structure to draw in the sufficient amount of air. On the other hand, in the axial fan A of this preferred embodiment, the space from which air is drawn in is ensured radially outside the outer edge 214 of the blade 21, on the air-inlet 14 side of the front edge 213 of the blade 21, and on the air-inlet 14 side of the lid 221 of the impeller cup 22 in the housing 1, while the blades 21 are turned about the rotation axis. Thus, air can be discharged toward the air outlet 15 while the blades 21 are turned. The axial fan A of this preferred embodiment is advantageous especially when another component or device serving as an obstacle is disposed outside the axial fan A next to the air inlet 14 of the axial fan A.

In general, an impeller is designed not to project beyond an air-inlet side end of an axial fan to the outside. In addition, a clearance is provided axially between the impeller and the air-inlet side end of the axial fan in order to prevent blades from projecting beyond the air-inlet side end of the axial fan even if an external force is applied to the axial fan. On the other hand, it is preferable that the effective area of projection of the blade 21 when seen in the rotating direction be large in order to improve the flow rate characteristics of the axial fan. However, the flow rate characteristics are largely degraded if another component or device is disposed outside the axial fan next to the air inlet 14 of the axial fan. In order to overcome this problem, a space from which air drawn in is provided on the air-inlet 14 side of the lid 221 of the impeller cup 22 in this preferred embodiment. More specifically, it is ideal that the axial thickness of the space from which air is drawn in, i.e., the axial distance between the air-inlet side end of the axial fan A and the lid 221 be approximately ⅛ or more of the axial thickness of the housing 1. The impeller 2 accommodated in the housing 1 is made as large as possible in order to effectively use the internal space of the housing 1. That is, the volume of the internal space of the housing 1 and the flow rate of the axial fan A depend on each other. If the axial thickness of the space from which air is drawn in is smaller than ⅛ of the axial thickness of the housing 1, it is not possible to ensure a space having an enough volume to draw air sufficient for flowing through the entire space in the housing 1. Furthermore, when a component or device which may disturb the axial fan A from drawing in air is disposed outside the axial fan A next to the air inlet 14, it is desirable that the axial thickness of the space between the lid 221 and the air-inlet side end of the axial fan A be approximately ⅕ or more of the axial thickness of the housing 1. In this case, the sufficient amount of air can be drawn in even if any obstacle is disposed next to the air inlet 14.

If a component or device is disposed outside the axial fan next to the air inlet 14, it is significantly difficult for the axial fan to drawn in air. In this case, however, lowering of the flow rate characteristics of the axial fan A can be suppressed by making the space from which air is drawn in larger. Furthermore, the impeller cup 22 in which the axial thickness of the lid 221 is as close as possible to zero would provide better flow rate characteristics and would be advantageous from a viewpoint of ensuring the space from which air is drawn in. However, this is technically impossible now because the impeller cup 22 accommodates the motor therein.

Figure 7:
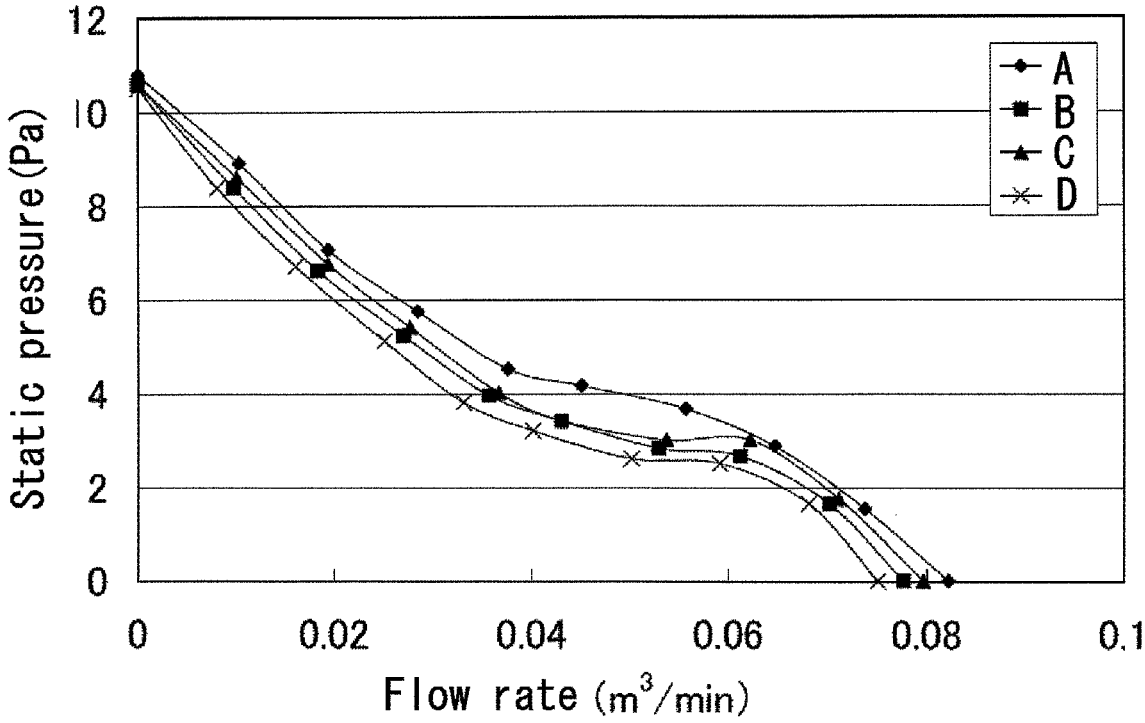
FIG. 7 shows a relationship between a flow rate and a static pressure in the axial fan according to the preferred embodiment of the present invention.
Figure 8A:
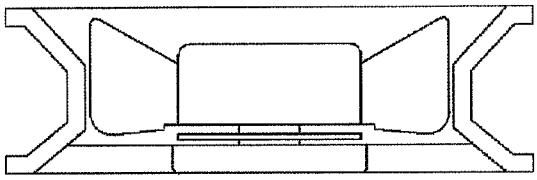
FIG. 8A shows the structure of the axial fan according to the preferred embodiment in a simplified manner.
Figure 8B:
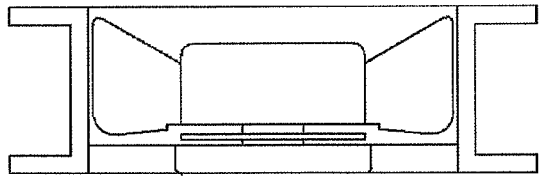
FIGS. 8B, 8C, and 8D show structures of axial fans used for comparison with the axial fan of FIG. 8A.
Figure 8C:
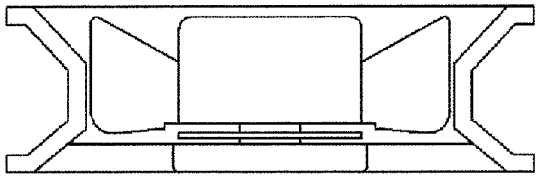
Figure 8D:
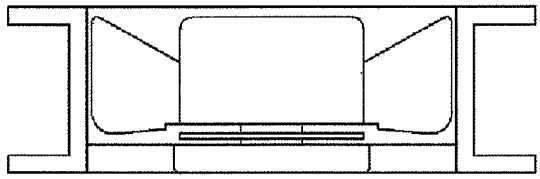

FIG. 7 shows a relationship between the flow rate ($m^3$/min) and the static pressure (Pa) which were measured for axial fans of Examples A, B, C, and D shown in FIGS. 8A, 8B, 8C, and 8D, respectively. Curves A, B, C, and D in FIG. 7 correspond to the axial fans of FIGS. 8A, 8B, 8C, and 8D, respectively. FIG. 8A schematically shows the axial fan of Example A which is the same as the axial fan A of the preferred embodiment shown in FIG. 1. In the axial fan A, the housing 1 is provided with the air-inlet side portion 112 and the air-inlet side end 212 of the radially outer edge 214 of the blade 21 is located on the air-inlet 14 side of the lid 221 of the impeller cup 22. FIG. 8B shows the axial fan in which the air-inlet side portion 112 is not provided and the air-inlet side end 212 of the radially outer edge 214 of the blade 21 is located on the air-inlet 14 side of the lid 221 of the impeller cup 22. FIG. 8C shows the axial fan in which the air-inlet side portion 112 is provided but the air-inlet side end 212 is not located on the air-inlet 14 side of the lid 221 of the impeller cup 22. FIG. 8D shows the axial fan in which the air-inlet side portion 112 is not provided and the air-inlet side end 212 of the blade 21 is not located on the air-inlet 14 side of the lid 221 of the impeller cup 22.

FIG. 7 shows that the P-Q (static pressure-flow rate) characteristics of the axial fan of FIG. 8D which does not have the characteristic features of the axial fan of the above preferred embodiment are the worst. The axial fans of FIGS. 8B and 8C are better in the P-Q characteristics than those of the axial fan of FIG. 8D, because each of the axial fans of FIGS. 8B and 8C has one of the characteristic features. The axial fan of FIG. 8A of the aforementioned preferred embodiment provides a high flow rate over the entire range of static pressure. The flow rate of the axial fan of FIG. 8A is high especially in an intermediate range of static pressure, e.g., approximately 3 Pa to approximately 6 Pa. Axial fans are usually used inside electronic devices to operate in the intermediate range of static pressure. That is, for most axial fans, an operation range of static pressure is the aforementioned intermediate range. Therefore, the axial fan of FIG. 8A, i.e., the axial fan according to the aforementioned preferred embodiment of the present invention has high cooling performance in a casing of an electronic device because of its high flow rate in the intermediate range of static pressure.

As described above, in the axial fan of the aforementioned preferred embodiment of the present invention, a portion of the blade 21 connected to the impeller cup 22, i.e., a root portion of the blade 21 is disposed on the air-outlet 15 side of the air-inlet 14 side end of the impeller cup 22 (the lid 221 of the impeller cup 22). The air-inlet side top end 212 of the blade 21 is located on the air-inlet 14 side of the air-inlet side end of the impeller cup 22 and is located axially between the air-inlet side end of the axial fan and the position at which the inner diameter of the housing 1 is the smallest. Therefore, the axial fan can provide a sufficiently high flow rate over the entire static pressure range irrespective of the environment in which the axial fan is placed.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An axial fan comprising:

a cup centered on a rotation axis and having at least a hollow, generally cylindrical portion;

a plurality of blades extending from an outer side surface of the cup in a radial direction perpendicular to or substantially perpendicular to the rotation axis, and turning about the rotation axis together with the cup to generate an axial airflow;

a housing defining a passage arranged to channel the airflow therein with an air inlet at one of axial ends of the passage and an air outlet at the other axial end, the air being drawn into the passage from the air inlet and being discharged from the air outlet, the housing including an air-inlet side portion having an inner diameter with a cross-sectional area of the passage on a plane perpendicular to the axial direction that increases toward the air inlet;

a motor, accommodated in the cup, arranged to rotate the cup;

a base portion arranged to support the motor; and a plurality of ribs extending from the base portion to the housing to connect the base portion to the housing, wherein each blade is connected to the cup at a root portion, an air-inlet side end of the root portion is located below an uppermost portion of the cup, and an air-inlet side end of a radially outer edge of each blade is located above the uppermost portion of the cup and axially between an air-inlet side end of the housing and a portion of the housing at which a cross-sectional area of the passage on a plane perpendicular to the rotation axis is the smallest.

2. An axial fan according to claim 1, wherein an air-inlet side edge of each blade which extends between the air-inlet side end of the distal end and the air-inlet side end of the root portion is at an angle with respect to the axial direction to approach the air outlet in a direction from the distal end to the root portion.

3. An axial fan according to claim 2, wherein an envelope formed by air-inlet side edges of the blades is defined by a generally conical surface.

4. An axial fan according to claim 2, wherein an envelope formed by air-inlet side edges of the blades is defined by a curved surface.

5. An axial fan according to claim 2, wherein the air-inlet side end of the root portion of each blade is located on an air-inlet side of a midpoint of an axial length of the cup at which an axial distance from an air-outlet side end of the cup is approximately a half of the axial length of the cup.

6. An axial fan according to claim 1, wherein the air-inlet side portion of the housing is a tapered surface which is tapered with respect to the axial direction.

7. An axial fan according to claim 1, wherein the air-inlet side portion of the housing is a curved surface which is convex toward outwardly in the radial direction.

8. An axial fan according to claim 1, wherein the air-inlet side portion of the housing is a curved surface which is convex toward inwardly in the radial direction.

9. An axial fan according to claim 1, wherein the air-inlet side end of the root portion of each blade is located on an air-outlet side of an air-outlet side end of the air-inlet side portion of the housing in the axial direction.

10. An axial fan according to claim 1, wherein an axial distance between the uppermost portion of the cup and the air-inlet side end of the housing is approximately ⅛ or more of an axial height of the housing from the base portion.

11. The axial fan according to claim 1, wherein an axial distance defined between a highest point of the cup and a highest point of the air-inlet side end of the blades in the axial direction is greater than an axial distance defined between the highest point of the cup and a highest point on the air-inlet side end of the blades at which the cup contacts the blades.

12. The axial fan according to claim 1, wherein an axial distance defined between a highest point of the cup and a highest point of the air-inlet side end of the blades in the axial direction is greater than an axial distance defined between a highest point of the cup and a lowest point of air-inlet side portion of the housing.

* * * * *